US006913445B1

(12) United States Patent
Beddard et al.

(10) Patent No.: US 6,913,445 B1
(45) Date of Patent: Jul. 5, 2005

(54) CENTER LOCATED CUTTER TEETH ON SHROUDED TURBINE BLADES

(75) Inventors: Thomas B. Beddard, Simpsonville, SC (US); Carlos A. Collado, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/707,420

(22) Filed: Dec. 12, 2003

(51) Int. Cl.[7] ..... F01D 11/12

(52) U.S. Cl. ..... 416/192; 416/191; 415/173.4; 415/173.6

(58) Field of Search ..... 416/191, 192; 415/173.4, 173.5, 173.6, 174.4, 174.5; 408/199, 408/227; 277/414, 415

(56) References Cited

U.S. PATENT DOCUMENTS

| | | | | |
|---|---|---|---|---|
| 3,377,050 | A * | 4/1968 | Guy | 416/191 |
| 5,238,364 | A * | 8/1993 | Kreitmeier | 415/173.6 |
| 6,241,471 | B1 | 6/2001 | Herron | |
| 6,506,022 | B2 | 1/2003 | Bunker | |
| 6,805,530 | B1 * | 10/2004 | Urban | 415/173.4 |
| 2004/0012151 | A1 * | 1/2004 | Beeck et al. | 277/415 |

FOREIGN PATENT DOCUMENTS

| | | | | |
|---|---|---|---|---|
| WO | WO 02/25065 | A1 * | 3/2002 | 277/415 |

* cited by examiner

*Primary Examiner*—Christopher Verdier
(74) *Attorney, Agent, or Firm*—Sutherland, Asbill & Brennan LLP

(57) ABSTRACT

A tip shroud for use with a bucket of a turbine. The tip shroud may include a seal rail with a middle portion and a cutter tooth mounted about the middle portion of the seal rail.

10 Claims, 2 Drawing Sheets

CENTER LOCATED CUTTER TEETH ON SHROUDED TURBINE BLADES

BACKGROUND OF INVENTION

The present invention relates generally to turbines and turbine blades and more particularly relates to tip shrouded turbine blades with center located cutter teeth.

A turbine assembly, such as that used in power generation, typically generates rotating shaft power by expanding hot compressed gas produced by combustion of a fuel. Gas turbine buckets or blades generally have an airfoil shape designed to convert the thermal and kinetic energy of the flow path gases into mechanical rotation of the rotor.

Turbine performance and efficiency may be enhanced by providing a seal at the tip of the bucket to block the flow of air over or around the top of the bucket that would otherwise bypass the bucket. For example, a tip shroud may be positioned on the end of the bucket opposite the end attached to the rotating shaft. The tip shroud generally includes a shelf and a sealing rail. This configuration reduces spillover by decreasing the size of the clearance gap and by interrupting the hot gas path around the end of the bucket. In addition, the sealing rail may have one or more cutter teeth thereon. The cutter teeth may further restrict spillover by cutting through a honeycomb-like structure that may surround the tip shroud.

Tip shrouds, however, are subject to creep damage due to the combination of high temperatures and centrifugally induce bending stresses. The failure of a single bucket or blade may cause the entire turbine to be taken offline. In addition to the downtime, such a repair of a bucket is time consuming and/or expensive.

There is a desire, therefore, for a turbine blade shroud with improved ability to handle temperature and stress. Such a turbine blade shroud should provide increased lifetime while also increasing the efficiency of the turbine system as whole.

SUMMARY OF INVENTION

The present invention thus provides a tip shroud for use with a bucket of a turbine. The tip shroud may include a seal rail with a middle portion and a cutter tooth mounted about the middle portion of the seal rail.

The cutter tooth may include a top portion and a base portion. The cutter tooth also may include a built-up area adjacent to the base portion. The cutter tooth may include a first cutter tooth and a second cutter tooth. The first cutter tooth and the second cutter tooth may include an offset position about the middle portion of the seal rail. The first cutter tooth may be positioned about 2.15 to about 2.2 inches (about 63.5 to about 55.9 millimeters) from a first end of the seal rail while the second tooth may be about 2.13 to about 2.18 inches (about 54.1 to about 55.37 millimeters) from the first end.

The seal rail may include a length of about 4.0 to about 4.25 inches (about 101.6 to about 107.9 millimeters). The first top portion and the second top portion may include a height from point "C" of about 0.52 to about 0.54 inches (about 13.21 to about 13.72 millimeters). The first top portion and the second top portion may include a width of about 0.10 to about 0.13 inches (about 2.54 to about 3.3 millimeters).

The first base portion of the first cutter tooth may extend in a direction perpendicular to the seal rail of about 0.56 to about 0.58 inches (about 14.22 to about 14.73 millimeters) while the second base portion of the second cutter tooth may extend about 0.45 to about 0.47 inches (about 11.43 to about 11.99 millimeters). The first base portion and the second base portion may include a width along the direction of the seal rail from about 0.5 to about 0.52 inches (about 12.7 to about 13.21 millimeters) to about 0.3 to about 0.32 inches (about 7.62 to about 8.19 millimeters) along the seal rail.

A further embodiment of the present invention may provide a tip shroud for use with a bucket of a turbine. The tip shroud may include a seal rail with a middle portion, a first cutter tooth mounted on the seal rail about the middle portion, and a second cutter tooth mounted on the seal rail about the middle portion. The first cutter tooth and the second cutter tooth may be offset along the middle portion on the seal rail. The first cutter tooth may be positioned about 2.15 to about 2.20 inches (about 54.61 to about 56.39 millimeters) from a first end of the seal rail while the second tooth may be about 2.13 to about 2.18 inches (about 54.1 to about 55.37 millimeters) from the first end.

A further embodiment of the present invention may provide a tip shroud for use with a bucket of a turbine. The tip shroud may include a seal rail with a first cutter tooth and a second cutter tooth mounted thereon about a middle portion thereof. The first cutter tooth may include a first base with a first length and the second cutter tooth may include a second base with a second length. The first length may exceed the second length.

These and other features of the present invention will become apparent upon review of the following detailed description when taken in conjunction with the drawings and the appended claims.

BRIEF DESCRIPTION OF DRAWINGS

Figure 1:
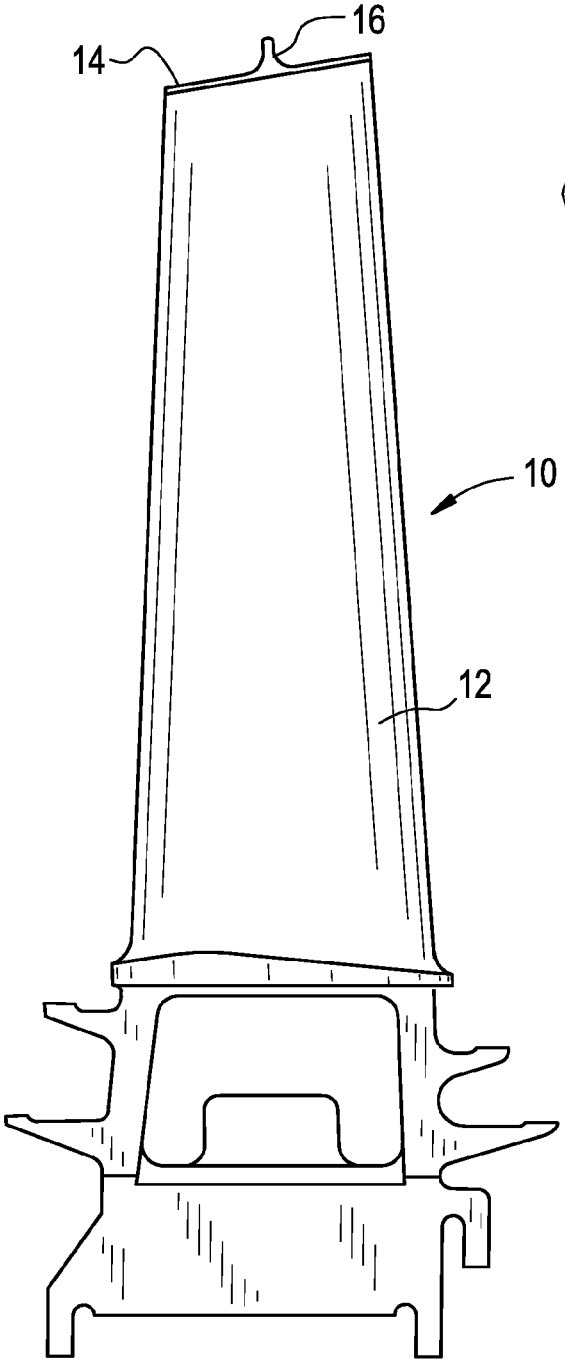
FIG. 1 PRIOR ART

Having thus described the invention in general terms, reference will now be made to the accompanying drawings, which are not necessarily drawn to scale, and wherein:

FIG. 1 is a side view of a known turbine bucket having a tip shroud.

Figure 2:
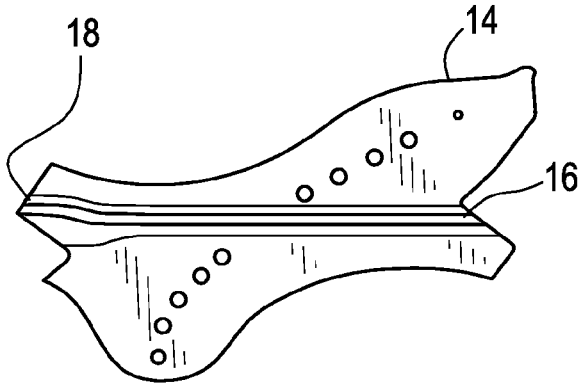
FIG. 2 PRIOR ART

FIG. 2 is a top plan view of a known tip shroud with a cutter tooth on the leading edge.

Figure 3:
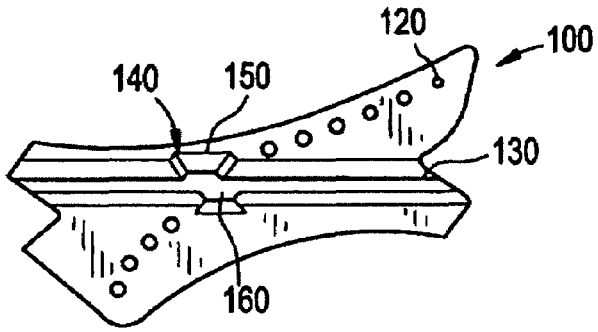

FIG. 3 is a top plan view of a tip shroud of the present invention showing a center mounted cutter tooth.

Figure 4:
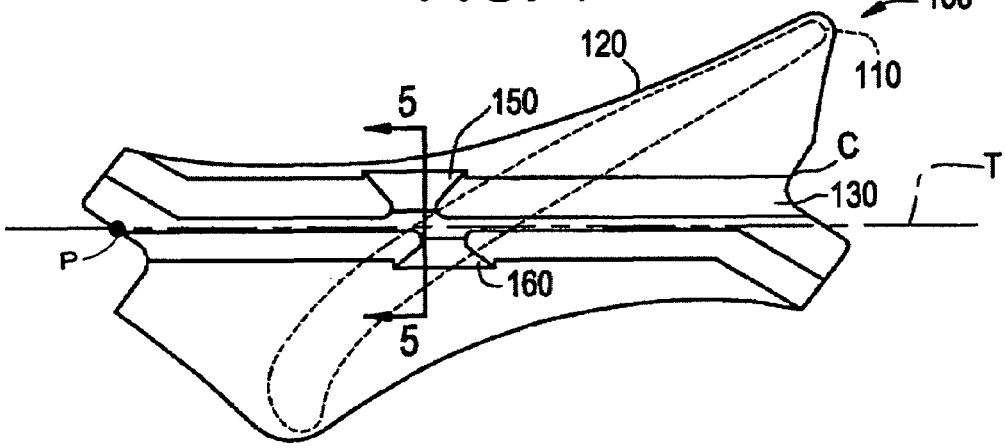

FIG. 4 is a top plan view of the tip shroud of FIG. 3 with the bucket or airfoil shown in phantom lines.

Figure 5:
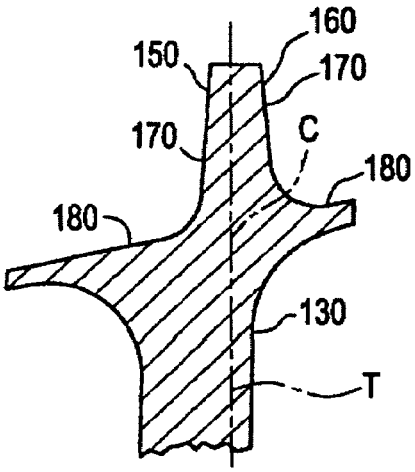

FIG. 5 is a side cross-sectional view of the cutter tooth of FIG. 4 taken along line 5—5.

Figure 6:
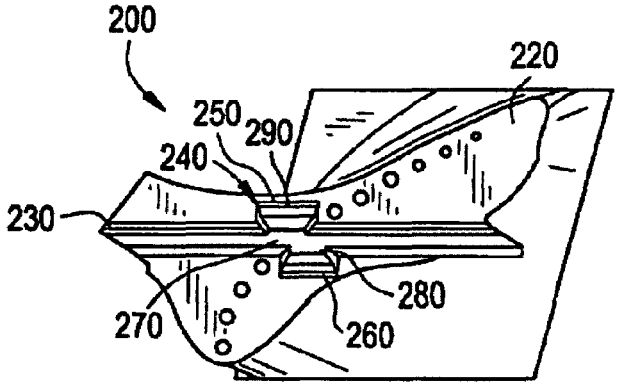

FIG. 6 is a top plan view of an alternative embodiment of the tip shroud of the present invention showing a center mounted cutter tooth

DETAILED DESCRIPTION

Referring now to the drawings, in which like numbers refer to like elements throughout the several views, FIG. 1 shows a typical tip shrouded turbine bucket 10. The turbine bucket 10 includes an airfoil 12. The airfoil 12 is the active component that intercepts the flow of gases and acts as a windmill vane to convert the energy of the gases into tangential motion. This motion in turn rotates the rotor to which the buckets 10 are attached.

A tip shroud 14 may be positioned at the top of the airfoil 12. The tip shroud 14 essentially is a flat plate supported towards its center by the airfoil 12. Positioned along the top of the tip shroud 14 may be a seal rail 16. The seal rail 16, as described above, prevents the passage of flow path gases through the gap between the tip shroud 14 and the inner surface of the surrounding components.

FIG. 2 shows the use of one or more known cutter teeth 18 on the seal rail 16. The cutter tooth 18 is positioned on the leading edge of the tip shroud 14. The use of the cutter teeth 18 may further reduce spillover by clearing a path through the honeycomb of the shroud that may be used for seal stability. The use of this leading edge position, however, may stress the tip shroud 14, particularly under high turbine temperatures.

FIGS. 3–5 show the improved turbine bucket 100 of the present invention. As above, the turbine bucket 100 includes the airfoil 110 (shown in phantom lines in FIG. 4.) The airfoil 110 ends in the tip shroud 120. The tip shroud 120 may be of conventional design. Positioned on top of the tip shroud may be a seal rail 130. The seal rail 130 may extend about the length of the tip shroud 120.

Positioned on the seal rail 130 may be one or more cutter teeth 140. In this example, the cutter teeth 140 are positioned about the center of the seal rail 130. A first cutter tooth 150 and a second cutter tooth 160 are shown. This location may extend the life of the turbine bucket 100 by decreasing the stress present in the fillet below the tip shroud 120. This location also provides a more symmetrical design to the tip shroud 120 as a whole.

Each cutter tooth 140 may have a top portion 170 that extends into a base portion 180. If the seal rail 130 is about 4.0 to about 4.25 inches long (about 101.6 to about 107.95 millimeters), the top portion 170 may have a length of about 0.329 inches (about 0.86 millimeters) and a width of about 0.1 to about 0.13 inches (about 2.54 to about 3.30 millimeters). The top portion 170 may have a height of about 0.52 to about 0.54 inches (about 13.21 to about 13.72 millimeters) from point "C".

The first tooth 150 and the second tooth 160 may be offset somewhat so as to accommodate the overall shape of the tip shroud 120. As is shown in FIG. 5, the top 170 of the first tooth 150 and the second tooth 160 may be offset along a centerline T of the tip shroud 120 and the seal rail 130. As such, the top 170 of the first tooth 150 may be about 2.15 to about 2.2 inches (about 54.6 to about 55.88 millimeters) from one end of the seal rail 130 located at point "P" while the top 170 of the second tooth 160 may be about 2.13 to about 2.18 inches (about 54.1 to about 55.32 millimeters) from that end located at point "P".

The base portion 180 of the first cutter tooth 150 may extend in a direction perpendicular to the seal rail 130 of about 0.56 to about 0.58 inches (about 14.22 to about 14.73 millimeters) while the base portion 180 of the second cutter tooth 160 may only extend about 0.45 to about 0.47 inches (about 11.43 to about 11.99 millimeters). The base portion 180 of both cutter teeth 150, 160 may have a width (along the direction of the seal rail 130) that extends from about 0.5 to about 0.52 inches (about 12.7 to about 13.21 millimeters) to about 0.30 to about 0.32 inches (about 7.62 to about 8.13 millimeters) near the top portion 170.

This configuration may be used for the second stage bucket of a turbine sold by the General Electric Company of Schenectady, New York under the designation "9FA+e". The configuration provides a tip shroud 120 with a more symmetrical design so as to reduce the stress on the tip shroud 120 as a whole and the fillet below the shroud 120, if one is present. The configuration also should increase the overall lifetime of the various parts.

FIG. 6 shows a similar design, in this case a turbine bucket 200 for the second stage bucket of a turbine sold by the General Electric Company of Schenectady, New York under the designation "7FA+e". The turbine bucket 200 may have an airfoil 210 with a tip shroud 220 and a seal rail 230. The tip shroud 220 may have somewhat different dimensions from those described above with the tip shroud 120.

Positioned on the seal rail 230 may be the cutter teeth 240, with a first cutter tooth 250 and a second cutter tooth 260. The cutter teeth 240 also may have a top portion 270 that meets along the seal rail 230 and a base 280. The base 280 may further include a built up area 290. The built up area 290 may provide for attachment of the cutter teeth 240 to the tip shroud 220. The cutter teeth 240 may be attached to the seal rail 230 and the tip shroud 220 by a welding of other types of conventional joinder methods.

In this case, if the seal rail 230 is about 4.0 to about 4.25 inches long (about 101.6 to about 107.95 millimeters), the top portion 270 may be about 0.52 to about 0.54 inches (about 13.21 to about 13.72 millimeters) in height and about 0.10 to about 0.13 inches (about 2.54 to about 3.3 millimeters) in width. The first tooth 250 and the second tooth 260 also may be offset somewhat. As such, the top 270 of the first tooth 250 may be about 2.15 to about 2.20 inches (about 54.61 to about 55.88 millimeters) from one end of the seal rail 230 while the top 270 of the second tooth 260 may be about 2.13 to about 2.18 inches (about 54.10 to about 55.37 millimeters) from that end.

The base portion 280 of the first cutter tooth 250 may extend in a direction perpendicular to the seal rail 230 by about 0.56 to about 0.580 inches (about 14.22 to about 14.73 millimeters) while the base portion 280 of the second cutter tooth 260 may only extend about 0.45 to about 0.47 inches (about 11.43 to about 11.99 millimeters). The base portion 280 of both cutter teeth 250, 260 may have a width (along the direction of the seal rail 230 that extends from about 0.50 to 0.52 inches (about 12.7 to about 13.21 millimeters) to about 0.30 to about 0.32 inches (about 7.62 to about 8.19 millimeters) near the top portion 270 along the seal rail 230. The built up area 290 may have of width of about 0.6 to about 0.7 inches (about 15.24 to about 17.78 millimeters).

It should be understood that the foregoing relates only to the preferred embodiments of the present invention and that numerous changes and modifications may be made herein without departing from the general spirit and scope of the invention as defined by the following claims and the equivalents thereof.

What is claimed is:

1. A tip shroud for use with a bucket of a turbine, comprising:

a seal rail;

a first cutter tooth mounted on said seal rail at about a middle portion thereof;

said first cutter tooth comprising a first base with a first length; and a second cutter tooth mounted on said seal rail at about said middle portion thereof;

said second cutter tooth comprising a second base with a second length;

wherein said first length exceeds said second length.

2. The tip shroud of claim 1, wherein said first cutter tooth and said second cutter tooth comprise an offset position about said middle portion of said seal rail.

3. The tip shroud of claim 1, wherein said first and second cutter teeth comprise a built-up area adjacent to said first base and said second base.

4. The tip shroud of claim 1, wherein said first cutter tooth comprises a first top portion about said first base and said second cutter tooth comprises a second top portion about said second base.

5. The tip shroud of claim 4, wherein said seal rail comprises a length of about 4.0 to about 4.25 inches.

6. The tip shroud of claim 5, wherein said first top portion and said second top portion comprise a height of about 0.52 to about 0.54 inches.

7. The tip shroud of claim 5, wherein said first top portion and said second top portion comprise a width of about 0.10 to about 0.13 inches.

8. The tip shroud of claim 5, wherein said first cutter tooth is positioned about 2.15 to about 2.20 inches from a first end of said seal rail while said second tooth may be about 2.13 to about 2.18 inches from said first end.

9. The turbine shroud of claim 5, wherein said first base of said first cutter tooth may extend in a direction perpendicular to said seal rail for about 0.56 to about 0.58 inches while said second base of said second cutter tooth may extend for about 0.45 to about 0.47 inches.

10. The turbine shroud of claim 5, wherein said first base and said second base both comprise a width along the direction of said seal rail from about 0.50 to about 0.52 inches to about 0.30 to about 0.32 inches along the seal rail.

* * * * *